US007450011B2

(12) United States Patent
Duschek

(10) Patent No.: US 7,450,011 B2
(45) Date of Patent: Nov. 11, 2008

(54) SECURITY TAG AND METHOD FOR SECURING ARTICLES

(75) Inventor: Detlef Duschek, Sensbachtal (DE)

(73) Assignee: Checkpoint Systems, Inc., Thorofare, NJ (US)

( * ) Notice: Subject to any disclaimer, the term of this patent is extended or adjusted under 35 U.S.C. 154(b) by 78 days.

(21) Appl. No.: 10/548,139

(22) PCT Filed: Jan. 28, 2004

(86) PCT No.: PCT/EP2004/000753

§ 371 (c)(1),
(2), (4) Date: Apr. 21, 2006

(87) PCT Pub. No.: WO2004/079683

PCT Pub. Date: Sep. 16, 2004

(65) Prior Publication Data

US 2006/0232424 A1 Oct. 19, 2006

(30) Foreign Application Priority Data

Mar. 7, 2003 (DE) ..... 103 10 135

(51) Int. Cl.
*G08B 13/14* (2006.01)

(52) U.S. Cl. ..... 340/572.8; 340/572.1; 40/638; 343/873

(58) Field of Classification Search ..... 340/572.8, 340/572.1, 572.3, 572.7; 29/829; 343/700 MS, 343/873

See application file for complete search history.

(56) References Cited

U.S. PATENT DOCUMENTS 5,417,790 A * 5/1995 Petrou ..... 156/249

(Continued)

FOREIGN PATENT DOCUMENTS

DE 20110222 9/2001

(Continued)

OTHER PUBLICATIONS

International Search Report, PCT/EP04/000753, dated Jun. 17, 2004.

*Primary Examiner*—Davetta W Goins
(74) *Attorney, Agent, or Firm*—Caesar, Rivise, Bernstein, Cohen & Pokotilow, Ltd.

(57) ABSTRACT

The invention is directed to a security tag (7') for protecting an article (1) against theft, with an electronically detectable first security element (3) and a covering layer (4) covering said first security element completely. The covering layer (4) is covered completely with a label (6) made of tearable material, which on its side facing the covering layer (4) is provided with an adhesive whose bonding strength is at least somewhat lower than that of the adhesive applied to the covering layer (4). Arranged between the covering layer (4) and the label (6) is a second security element (5), which overlaps the covering layer (4) at least in part and is provided on its side facing the covering layer (4) with an adhesive whose bonding strength is somewhat greater than that of the adhesive applied to the label (6). The covering layer (4) and the second security element (5) are completely covered by the label (6). With this construction of the security tag (7) it is ensured that a removal of the security elements (3, 5) from the secured article (1) is not possible at all or only with great difficulty.

16 Claims, 2 Drawing Sheets

U.S. PATENT DOCUMENTS

| | | | | |
|---|---|---|---|---|
| 5,884,425 | A * | 3/1999 | Baldwin | 40/638 |
| 5,895,075 | A * | 4/1999 | Edwards | 283/81 |
| 5,910,349 | A * | 6/1999 | Tsukuda | 428/42.3 |
| 5,920,290 | A * | 7/1999 | McDonough et al. | 343/873 |
| 5,982,284 | A * | 11/1999 | Baldwin et al. | 340/572.8 |
| 6,451,154 | B1 * | 9/2002 | Grabau et al. | 156/300 |
| 6,520,544 | B1 * | 2/2003 | Mitchell et al. | 283/70 |
| 6,794,000 | B2 * | 9/2004 | Adams et al. | 428/40.1 |
| 7,049,962 | B2 * | 5/2006 | Atherton et al. | 340/572.1 |
| 7,095,324 | B2 * | 8/2006 | Conwell et al. | 340/572.1 |
| 7,113,131 | B2 * | 9/2006 | Burke | 343/700 MS |
| 7,211,163 | B2 * | 5/2007 | Kennedy | 156/247 |
| 7,375,635 | B2 * | 5/2008 | Kessler | 340/572.1 |
| 2002/0135481 | A1 | 9/2002 | Conwell et al. | |

FOREIGN PATENT DOCUMENTS

| | | |
|---|---|---|
| EP | 0354759 | 2/1990 |
| EP | 0446910 | 9/1991 |
| FR | 2614109 | 10/1988 |

* cited by examiner

FIG.1
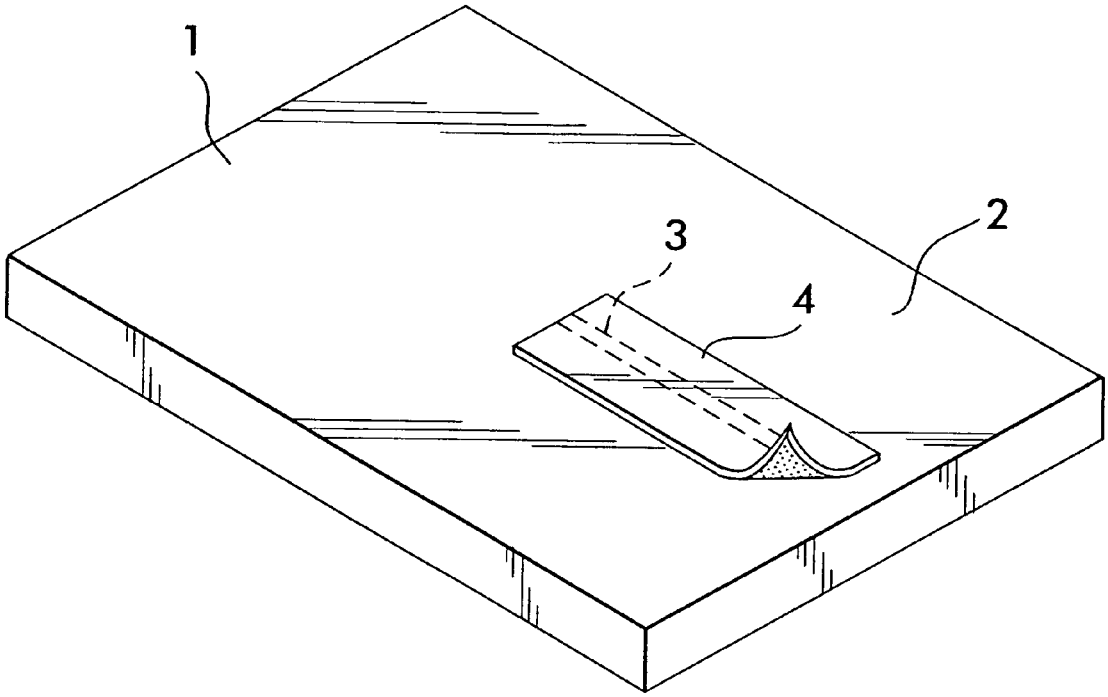
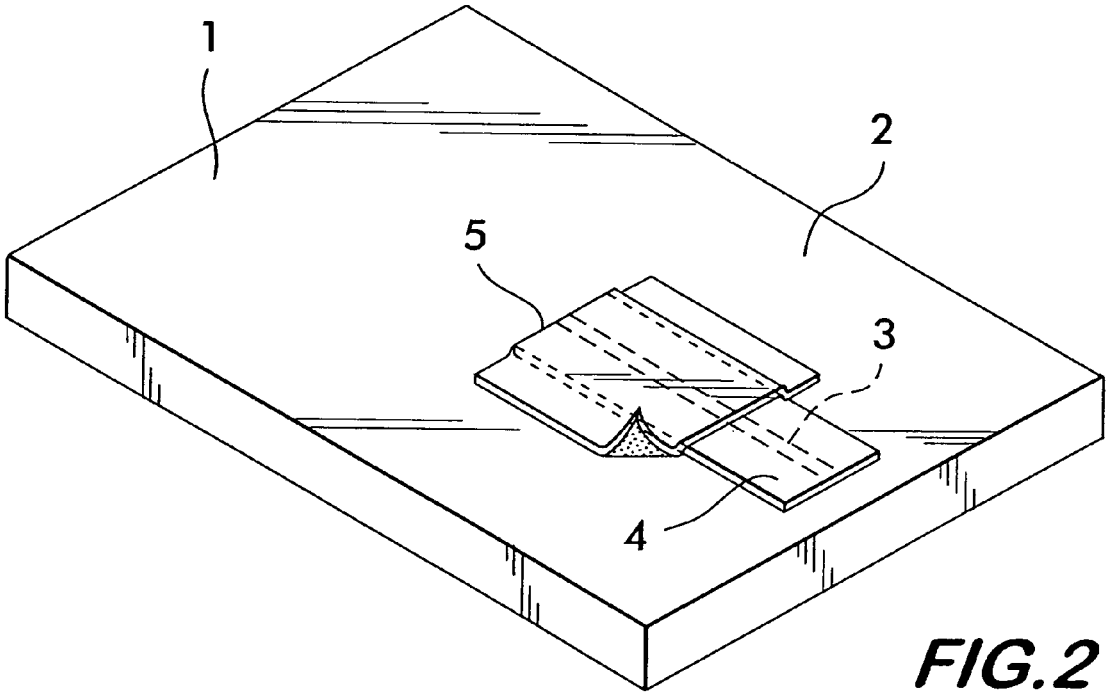
FIG.2

SECURITY TAG AND METHOD FOR SECURING ARTICLES

BACKGROUND OF THE INVENTION

This invention relates to a security tag for protecting articles against theft, with at least one, preferably electronically detectable security element and at least one covering layer covering the security element completely and being provided with an adhesive on its side facing the security element. The present invention further relates to a method of protecting articles against theft by means of at least one, preferably electronically detectable security element which is attached to the article to be protected.

Security tags of the type initially referred to as well as corresponding methods for protecting articles against theft are known in the art to secure articles offered for sale or for rent as, for example, video cassettes. Attached to these articles is a security element which may be an electric resonant circuit, for example. When an attempt is made to remove an unpaid article from the salesroom, the security element produces an alarm when carried past detection devices conventionally installed close to the exit. By contrast, when the article is paid for and hence legitimately purchased, the security element has to be removed from the article to prevent the alarm being activated. Alternatively, it is also possible for the security elements to be of the deactivatable type, in which case they only have to be deactivated when the article is paid for and may remain attached to the article. This is particularly useful in connection with rental items because it is not necessary to attach a new security element to the article after the article is returned but enables the still attached security element to be simply reactivated.

Such methods have the disadvantage that the security elements are affixed to the article either visibly or can be easily located by experienced shoplifters. With sufficient criminal energy a potential shoplifter needs only remove the located security element from the article in order to be able to leave the salesroom unnoticed with the now unprotected article. In particular security elements which are adhered to the articles in known manner by means of one or several plastic films are easy to remove.

EP 0 446 910 A1, for example, discloses a security tag comprised of an electronically detectable, deactivatable security element and a self-adhesive coating covering the security element. The deactivatable security element is a soft magnetic strip element onto which rectangular elements of a hard magnetic material are applied. For storage and transportation purposes, this security element is adhered to a peel strip. On its other side the security element is completely covered by a covering layer of paper or plastic, with the covering layer being provided with an adhesive layer on its side facing the security element. When the peel strip is removed, the security element with the then exposed adhesive layer can be adhered to an item to be protected. This known security tag has likewise the disadvantage that it can be detached from the item to be protected relatively easily.

SUMMARY OF THE INVENTION

It is an object of the present invention to provide a security tag and a method of the type initially referred to, in which a removal of the security element from the secured article is not possible at all or only with great difficulty.

According to the present invention this object is accomplished with a security tag of the type initially referred to by covering the covering layer completely with a label made of tearable material, which on its side facing the covering layer is provided with an adhesive whose bonding strength is at least somewhat lower than that of the adhesive applied to the covering layer.

According to the invention the covering layer by means of which the security element is affixed to the article is thus covered completely by another layer. When trying to remove the security element from the article, a potential shoplifter has to remove first the additional layer which is formed by a label made of tearable material. The bonding strength of the adhesive with which the label is adhered to the covering layer and the article is at least somewhat lower than the bonding strength of the adhesive with which the covering layer is adhered to the security element and the article. On account of the different adhesives used it is therefore not possible for the covering layer to be peeled from the article or from the security element simultaneously with the label. The bonding strength of the adhesive of the label should be selected to cause tearing or splitting of the label when an attempt is made to remove it from the article. In this manner removal of the label is laborious and only possible piece by piece. In an attempt to remove the label from the article, an adhesive layer and part of the label invariably remain on the article. Should a potential shoplifter nevertheless succeed in removing part of the label, the covering layer with the stronger adhesive would still adhere to the article. Hence the entire procedure is so time-consuming that a potential shoplifter gives up, leaving the article in the salesroom. Furthermore, by rendering the removal of the security element more difficult, the probability of the potential shoplifter being detected by the sales personnel or a detective is increased.

In an advantageous aspect of the invention the covering layer is provided with a very strongly adhering adhesive. The adhesive should be selected so that a removal of the covering layer and hence of the security element from the article to be protected is not possible at all or only with very great effort. Desirably, the bonding strength is significantly greater than the bonding strength of the adhesive with which the label is provided. This ensures that the covering layer reliably adheres to the article when a potential shoplifter tries to remove the label.

According to a particularly advantageous aspect of the invention the covering layer is a plastic film, preferably a polyester film, and/or the label is made of paper or easily tearable and/or perforated plastic. Through the use of a plastic film as covering layer, in particular a hard-wearing polyester film, it is ensured that the security element is affixed to the object to be secured in a protected, reliable and lasting way. When the label is made of paper or an equally easily tearable plastics material, it cannot be peeled from the article and the covering layer in one piece. Rather, a label constructed in this manner will tear into small pieces when an attempt is made to peel it off, so that its complete removal takes a very long time. A plastic label may also have irregular perforations distributed over its area, so that lines of preferred breaking are produced making it impossible to peel the label off in a single piece. When the label is made of paper the paper is preferably multi-layered causing the paper to split during a peeling attempt. In this way a potential shoplifter has to remove the label practically layer by layer which further adds to the expenditure of time significantly. Ideally, the last thin paper layer provided with the adhesive remains on the article to be protected. Experience has shown that such a thin paper layer cannot be removed from an object completely in a short time. This makes it virtually impossible for a potential shoplifter to remove the security element from the object to be secured.

To increase the rate of detection, a second security element may be arranged between the covering layer and the label, which second security element is provided with an adhesive on one side facing the covering layer and overlaps the covering layer at least in part. In this arrangement the second security element is preferably dimensioned in such a manner that large parts of it adhere with the adhesive layer to the object to be protected. Because it overlaps the first security element at least in part, additional protection is thereby afforded. Alternatively, the possibility also exists to employ different layers of soft magnetic and hard magnetic material as security elements, whereby repeated activation and deactivation of the security elements is possible, which is an advantage in particular when securing rental items.

When in the presence of a second security element this is equally provided with a strongly adhering adhesive whose bonding strength is at least somewhat greater than the bonding strength of the adhesive applied to the label, it is likewise not possible for the second security element to be removed simultaneously with the label. In an advantageous aspect of the invention the adhesive layer of the second security element should at the same time have a lower bonding strength than the adhesive applied to the covering layer. In such an embodiment there is virtually a grading of the layers with regard to their bonding strength, making it necessary for a potential shoplifter to remove each layer separately. This is apt to add further to the time needing to be spent by a potential shoplifter.

In the event of a second security element being used, this should equally be completely covered by the label so as not to suggest a potential shoplifter where to start with its direct removal without first having to remove the label.

In another advantageous aspect of the invention the security element is a strip-shaped element and/or the second security element is a thin-film element. The strip-shaped security element is preferably deactivatable, enabling repeated activation and deactivation which is advantageous in particular for the securing of rental items such as video cassettes. The use of strip-shaped and/or thin-film elements has the added advantage of a low layer thickness, rendering the entire security tag so thin that it is not obtrusive on the article to be protected.

The security elements involved may be, for example, electromagnetic (EM), acoustomagnetic (AM), radio frequency (RF) or radio frequency identification (RFID) elements. According to the invention, different types of security element may hence find application, with flat security elements being preferred. The use of flat security elements forming no obtrusive elevation on the article to be protected prolongs their service life, which is of special importance particularly with rental items.

According to the invention the security tag of the invention is preferably affixed to a substrate. The substrate may be a carrier web or a secured article.

The object of the invention is further accomplished by a method of the type initially referred to, which includes fixing the security element directly on the article by means of a covering layer provided with an adhesive on its side facing the security element, with the covering layer covering the security element completely, and adhering a label of tearable material to the article by means of an adhesive whose bonding strength is at least somewhat lower than that of the adhesive applied to the covering layer, with the label overlapping the covering layer completely.

The covering layer is preferably provided with a very strongly adhering adhesive, with the covering layer being, for example, a plastic film, preferably a polyester film, that may be adhered to the article.

As label a paper label, in particular made of multilayered paper, or a plastic label made of an easily tearable and/or perforated plastics material is adhered to the article and the covering layer.

In a particular embodiment of the invention this may be preceded by the step of adhering a second security element over at least part of the covering layer, whose side facing the covering layer is likewise provided with a strongly adhering adhesive having a bonding strength at least somewhat greater than the bonding strength of the adhesive applied to the label, with the second security element and a still exposed part of the covering layer being then completely covered with the label.

BRIEF DESCRIPTION OF THE SEVERAL VIEWS OF THE DRAWINGS

The present invention will be described in more detail in the following with reference to the Figures of the accompanying drawing. In the drawing, FIG. 1 is a perspective view of an article secured by a first embodiment of the security tag of the invention;

FIG. 2 is a perspective view of an article secured by a second embodiment of the security tag of the invention, with a label covering two security elements being not shown.

DETAILED DESCRIPTION OF THE PREFERRED EMBODIMENTS

Figure 3:
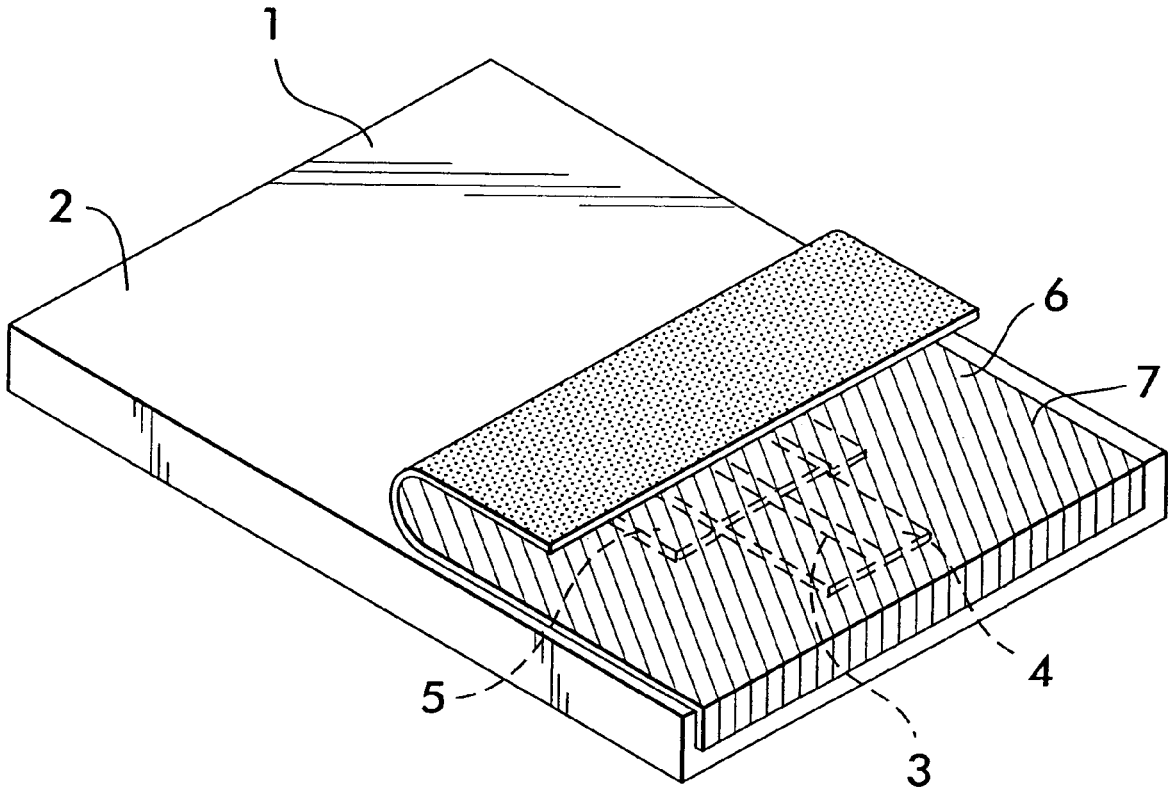
FIG. 3 is a perspective view of the article of FIG. 2 showing the complete security tag of the invention.

FIG. 1 shows an article 1 protected by a security tag 7 according to a first embodiment of the invention, which article can be a video cassette, for example. Applied to the surface 2 of the article 1 is a security element 3. The security element 3 involved is a strip-shaped electromagnetic (EM) element which is preferably deactivatable. Such a strip element may be of a width of about 0.7 mm, for example. The security element 3 is affixed to the surface 2 by means of a covering layer 4. Accordingly, the security element 3 rests directly on the surface 2 of the article 1 to be secured and is fixed on the article 1 by means of the covering layer 4. In this embodiment the covering layer 4 is a polyester film which may have a thickness of 50 μm, for example. The covering layer 4 overlaps the security element 3 on either longitudinal side, so that its adhesive layer applied to the side facing the security element 3 adheres reliably to the surface 2. The covering layer 4 may have a width of about 5 mm, for example. The covering layer 4 is adhered to the surface 2 and to the security element 3 with a very strongly adhering adhesive. The covering layer 4 is completely covered by a label 6 described in more detail with reference to FIG. 3.

FIG. 2 shows the article 1 to be secured together with a first security element 3 fixed by means of the covering layer 4. Adhered over part of the covering layer 4 is a second security element 5. The second security element 5 is a thin-film element which is coated with a strongly adhering adhesive on its side facing the surface 2. In the example shown, the second security element 5 has a surface area of 20×28 mm, hence overlapping the covering layer 4 on three sides. This enables the adhesive applied to the second security element 5 to adhere to the surface 2 over a large area. The bonding strength of the adhesive applied to the second security element 5 is preferably somewhat lower than the bonding strength of the adhesive with which the covering layer 4 is adhered to the surface 2. Alternatively, however, the bonding strengths of the adhesives of the covering layer 4 and the second security element 5 may also be approximately equal. Hence, for fixing the first security element 3 and for adhering the second security element 5, like or different adhesives may be used. Not shown in FIG. 2 is the label 6 which completely covers the second security element 5 and the portion of the covering layer 4 left exposed by the second security element 5.

FIG. 3 shows the article 1 to be protected of FIG. 2, in which the two security elements 3, 5 as well as the covering layer 4 are completely covered by a label 6. The label 6 is provided with an adhesive on its side facing the surface 2 and the covering layer 4. With this adhesive the label 6 is adhered to a large area of the surface 2. As such it covers the covering layer 4 and the second security element 5 completely. In the present embodiment the complete security tag 7 is hence comprised of the first security element 3, a covering layer 4, the second security element 5 and the label 6. The adhesive with which the label 6 adheres to the surface 2 has a lower bonding strength than the adhesive applied to the covering layer. Advantageously, the adhesive applied to the label 6 has likewise a lower bonding strength than the adhesive applied to the second security element 5. In this way it is ensured that in an attempt to remove the security tag 7 only the label 6 becomes initially detached, whilst the second security element 5 and the first security element 3 remain adhered to the article 1 to be secured. The label 6 is preferably made of paper, in particular multi-layered paper, which splits and tears when an attempt is made to remove the security tag 7. Accordingly, it will take some time until substantial parts of the label 6 are removed. In cases where multi-layered paper is used, the bottommost thin layer ideally remains on the surface 2 together with the adhesive layer. Even in the event of a potential shoplifter succeeding in removing large parts of the label 6 from the surface, the security elements 3, 5 would still remain affixed to the surface 2, because these are adhered to the surface 2 with very strongly adhering adhesives. Overall, therefore, the attempt to remove the security tag 7 from the article 1 to be protected takes so much time that the potential shoplifter is either detected or, unnerved, gives up. In the embodiment of the security tag 7 of FIG. 1 the label 6 has the same construction as in the embodiment of the security tag 7 of FIGS. 2 and 3.

LIST OF REFERENCES

1 Article
2 Surface
3 First Security Element
4 Covering Layer
5 Second Security Element
6 Label
7 Security Tag

The invention claimed is:

1. A security tag for protecting articles against theft, with at least one, preferably electronically detectable security element and at least one covering layer covering the security element completely and being provided with an adhesive on its side facing the security element for fixing the security element to the article, wherein the covering layer is covered completely with a label made of tearable material, which on its side facing the covering layer is provided with an adhesive whose bonding strength is at least somewhat lower than that of the adhesive applied to the covering layer.

2. The security tag as claimed in claim 1, wherein the covering layer is provided with a very strongly adhering adhesive.

3. The security tag as claimed in claim 2, wherein the covering layer is a plastic film, preferably a polyester film.

4. The security tag as claimed in claim 1, wherein the label is made of preferably multi-layered paper or of an easily tearable and/or perforated plastics material.

5. The security tag as claimed in claim 1, wherein a second security element is arranged between the covering layer and the label, which second security element is provided with an adhesive on one side facing the covering layer and overlaps the covering layer at least in part.

6. The security tag as claimed in claim 5, wherein the second security element is equally provided with a strongly adhering adhesive whose bonding strength is at least somewhat greater than the bonding strength of the adhesive applied to the label.

7. The security tag as claimed in claim 5, wherein the label completely covers the second security element and the covering layer.

8. The security tag as claimed in claim 5, wherein the second security element is a thin-film element.

9. The security tag as claimed in claim 1, wherein the security element is a strip-shaped, preferably deactivatable element.

10. The security tag as claimed in claim 1, wherein the security element is an EM, AM, RF or RFID element.

11. The security tag as claimed in claim 1, wherein it is affixed to a substrate.

12. The security tag as claimed in claim 11, wherein the substrate is a carrier web or a secured article.

13. A method of protecting articles against theft by means of at least one, preferably electronically detectable security element which is attached to the article to be protected, comprising the steps of fixing the security element directly on the article by means of a covering layer provided with an adhesive on its side facing the security element, said covering layer covering the security element completely and overlapping the security element, and adhering a label of tearable material to the article by means of an adhesive whose bonding strength is at least somewhat lower than that of the adhesive applied to the covering layer, with the label overlapping the covering layer completely.

14. The method as claimed in claim 13, wherein the step of providing the covering layer with a very strongly adhering adhesive and/or adhering as covering layer a plastic film, preferably a polyester film, to the article.

15. The method as claimed in claim 13, wherein the step of adhering a label as a paper label, preferably of multilayered paper, or a plastic label made of an easily tearable and/or perforated plastics material to the article and the covering layer.

16. The method as claimed in claim 13, further comprising the steps of adhering a second security element over at least part of the covering layer, whose side facing the covering layer is likewise provided with a strongly adhering adhesive having a bonding strength at least somewhat greater than the bonding strength of the adhesive applied to the label, and subsequently covering the second security element and a still exposed part of the covering layer completely with the label.

* * * * *